US011401573B2

(12) United States Patent
Nishida et al.

(10) Patent No.: US 11,401,573 B2
(45) Date of Patent: Aug. 2, 2022

(54) FERRITIC STAINLESS STEEL SHEET AND METHOD FOR MANUFACTURING THE SAME

(71) Applicant: JFE STEEL CORPORATION, Tokyo (JP)

(72) Inventors: Shuji Nishida, Tokyo (JP); Tomohiro Ishii, Tokyo (JP); Masataka Yoshino, Tokyo (JP); Mitsuyuki Fujisawa, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 187 days.

(21) Appl. No.: 16/607,420

(22) PCT Filed: Apr. 13, 2018

(86) PCT No.: PCT/JP2018/015578
§ 371 (c)(1),
(2) Date: Oct. 23, 2019

(87) PCT Pub. No.: WO2018/198834
PCT Pub. Date: Nov. 1, 2018

(65) Prior Publication Data

US 2020/0299800 A1 Sep. 24, 2020

(30) Foreign Application Priority Data

Apr. 25, 2017 (JP) ..... JP2017-086009
Mar. 6, 2018 (JP) ..... JP2018-039384

(51) Int. Cl.

| | |
|---|---|
| ***C21D 9/46*** | (2006.01) |
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |
| ***C22C 38/60*** | (2006.01) |

(52) U.S. Cl.

CPC ..... *C21D 9/46* (2013.01); *C21D 6/004* (2013.01); *C21D 6/005* (2013.01); *C21D 6/008* (2013.01); *C21D 8/0205* (2013.01); *C21D 8/0226* (2013.01); *C21D 8/0236* (2013.01); *C21D 8/0263* (2013.01); *C21D 8/0273* (2013.01); *C22C 38/001* (2013.01); *C22C 38/002* (2013.01); *C22C 38/004* (2013.01); *C22C 38/008* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C22C 38/60* (2013.01); *C21D 2211/005* (2013.01)

(58) Field of Classification Search

CPC .. C21D 2211/005; C21D 6/004; C21D 6/005; C21D 6/008; C21D 8/0205; C21D 8/0226; C21D 8/0236; C21D 8/0263; C21D 8/0273; C21D 9/46; C22C 38/001; C22C 38/002; C22C 38/004; C22C 38/008; C22C 38/02; C22C 38/04; C22C 38/06; C22C 38/42; C22C 38/44; C22C 38/46; C22C 38/48; C22C 38/50; C22C 38/52; C22C 38/54; C22C 38/60

See application file for complete search history.

(56) References Cited

U.S. PATENT DOCUMENTS

2002/0074067 A1* 6/2002 Ota ..... C22C 38/18 148/610
2014/0216614 A1* 8/2014 Hatano ..... C22C 38/44 148/602

(Continued)

FOREIGN PATENT DOCUMENTS

CN 103608479 A 2/2014
EP 1491646 B1 * 5/2012 ..... C21C 7/0006

(Continued)

OTHER PUBLICATIONS

Jul. 6, 2018 International Search Report issued in International Patent Application No. PCT/JP2018/015578.

(Continued)

*Primary Examiner* — Jenny R Wu

(74) *Attorney, Agent, or Firm* — Oliff PLC

(57) ABSTRACT

A ferritic stainless steel sheet having excellent corrosion resistance, formability, and ridging resistance and a method for manufacturing the same are provided. A ferritic stainless steel sheet has a chemical composition containing, in terms of mass %, C: 0.005 to 0.030%, Si: 0.05 to 1.00%, Mn: 0.05 to 1.00%, P: 0.040% or less, S: 0.030% or less, Al: 0.001 to 0.150%, Cr: 10.8 to 14.4%, Ni: 0.01 to 2.50%, and N: 0.005 to 0.060%, with the balance being Fe and incidental impurities. The elongation after fracture is 28% or more, and the ridging height of a surface of a steel sheet to which a tensile strain of 23% has been applied in a rolling direction is 3.0 μm or less.

18 Claims, No Drawings

(56) References Cited

U.S. PATENT DOCUMENTS

| | | | | |
|---|---|---|---|---|
| 2015/0376732 | A1 | 12/2015 | Hamada et al. | |
| 2017/0314093 | A1* | 11/2017 | Hamada | C21D 8/0268 |
| 2018/0171430 | A1* | 6/2018 | Yoshino | C21D 6/008 |

FOREIGN PATENT DOCUMENTS

| | | | | |
|---|---|---|---|---|
| EP | 2722411 | A1 | | 4/2014 |
| JP | S47-001878 | B | | 8/1972 |
| JP | H0526849 | B2 | | 4/1993 |
| JP | H10-121205 | A | | 5/1998 |
| JP | 2001089814 | A | | 4/2001 |
| JP | 2001-271143 | A | | 10/2001 |
| JP | 2001-294991 | A | | 10/2001 |
| JP | 2004-002974 | A | | 1/2004 |
| JP | 3584881 | B2 | | 11/2004 |
| JP | 2006-104498 | A | | 4/2006 |
| JP | 2006-328524 | A | | 12/2006 |
| JP | 2008-138270 | A | | 6/2008 |
| JP | 2009-235555 | A | | 10/2009 |
| JP | 2016-041846 | A | | 3/2016 |
| JP | 2016041846 | A | * | 3/2016 |
| JP | 5904310 | B1 | | 4/2016 |
| JP | 2016-113670 | A | | 6/2016 |
| JP | 2016108605 | A | | 6/2016 |
| JP | 2017-508067 | A | | 3/2017 |
| TW | I503422 | B | | 10/2015 |
| TW | 201702406 | A | | 1/2017 |
| WO | 2014/045542 | A1 | | 3/2014 |
| WO | 2014/119796 | A1 | | 8/2014 |
| WO | 2016/051437 | A1 | | 4/2016 |
| WO | 2016/068139 | A1 | | 5/2016 |
| WO | 2016/092714 | A1 | | 6/2016 |
| WO | 2017/002147 | A1 | | 1/2017 |
| WO | 2017/002148 | A1 | | 1/2017 |
| WO | WO-2017002147 | A1 | * | 1/2017 | C22C 38/50 |

OTHER PUBLICATIONS

Jan. 4, 2021 Office Action issued in Korean Patent Application No. 10-2019-7031020.

Mar. 20, 2019 Office Action issued in Taiwanese Patent Application No. 107113709.

Oct. 24, 2018 Office Action issued in Taiwanese Patent Application No. 107113709.

Nov. 12, 2020 Office Action issued in Chinese Patent Application No. 201880026797.9.

Apr. 20, 2021 Office Action issued in Chinese Patent Application No. 201880026797.9.

Sep. 16, 2021 Office Action issued in Chinese Patent Application No. 201880026797.9.

Mar. 4, 2022 Office Action issued in Chinese Patent Application No. 201880026797.9.

* cited by examiner

FERRITIC STAINLESS STEEL SHEET AND METHOD FOR MANUFACTURING THE SAME

TECHNICAL FIELD

This application relates to a ferritic stainless steel sheet that has excellent corrosion resistance, formability, and ridging resistance.

BACKGROUND

Ferritic stainless steel sheets are low-cost, excellent price-stable material compared to austenitic stainless steel sheets since the Ni content is not high, and have been used in various applications, such as building materials, transportation equipment, and home electric appliances, due to excellent corrosion resistance. In particular, unlike austenitic stainless steel sheets, ferritic stainless steel sheets have magnetism, and, thus, are increasingly used in cooking tools, which are available for induction heating (IH) systems. Cooking tools such as pots are mostly formed by bulging. Thus, sufficient elongation is necessary to obtain a desired shape.

Meanwhile, ferritic stainless steel sheets have a problem in that, during forming, surface irregularities (ridging) that deteriorate appearance frequently occur on the surfaces. The surface appearance determines commercial value of cooking tools, therefore if ridging occurs on their surface, a polishing step for removing the irregularities must be performed after forming. In other words, there is a problem in that occurrence of extensive ridging increases the manufacturing cost. In general, extensive ridging tends to appear when larger strain is applied to the ferritic stainless steel sheet, in other words, when severe working is performed.

In recent years, shapes of home cooking tools have become increasingly diverse, and thus ferritic stainless steel sheets that can be subjected to severer working are in demand. In other words, ferritic stainless steel sheets with higher elongation are desirable.

However, it is also desirable to decrease the manufacturing cost of home cooking tools. In other words, ferritic stainless steel sheets in which ridging that causes the increase in manufacturing cost, is decreased are desired.

In response to these requests, there is a demand for a ferritic stainless steel sheet that has higher elongation and reduces ridging sufficiently even if strain larger than conventional one is applied.

Regarding the aforementioned problem, for example, Patent Literature 1 discloses a ferritic stainless steel sheet having excellent formability, characterized in containing, in terms of mass %, C: 0.02 to 0.06%, Si: 1.0% or less, Mn: 1.0% or less, P: 0.05% or less, S: 0.01% or less, Al: 0.005% or less, Ti: 0.005% or less, Cr: 11 to 30%, and Ni: 0.7% or less, and satisfying $0.06 \leq (C+N) \leq 0.12$, $1 \leq N/C$, and $1.5 \times 10^{-3} \leq (V \times N) \leq 1.5 \times 10^{-2}$ (C, N, and V respectively represents contents of the elements in mass %).

Patent Literature 2 discloses a method for manufacturing a ferritic stainless steel sheet having excellent ridging resistance and formability, characterized in that a hot-rolled sheet of a ferritic stainless steel sheet containing, in terms of weight %, 0.15% or less of C and 13 to 25% of Cr is annealed for 10 minutes or less in a range of 930 to 990° C. where austenite and ferrite phases coexist so as to form a two-phase structure of a martensite phase and a ferrite phase, the resulting annealed sheet is cold-rolled, and the resulting cold-rolled sheet is annealed in a range of 750 to 860° C.

Patent Literature 3 discloses a ferritic stainless steel containing, in terms of mass %, C: 0.005 to 0.035%, Si: 0.25% to less than 0.40%, Mn: 0.05 to 0.35%, P: 0.040% or less, S: 0.01% or less, Cr: 15.5 to 18.0%, Al: 0.001 to 0.10%, and N: 0.01 to 0.06% with the balance being Fe and incidental impurities, where Si and Mn satisfy $29.5 \times Si - 50 \times Mn + 6 \geq 0$.

CITATION LIST

Patent Literature

PTL 1: Japanese Patent No. 3584881

PTL 2: Japanese Examined Patent Application Publication No. 47-1878

PTL 3: Japanese Patent No. 5904310

SUMMARY

Technical Problem

In the invention disclosed in Patent Literature 1, ridging evaluation is carried out on a test piece subjected to a prestrain of 20%, and ridging that occurs due to severer working is not sufficiently evaluated. The inventors of the presently disclosed embodiments prepared various kinds of steel sheets by methods described in Patent Literature 1, and the ridging height that occurred when a prestrain of 23% was applied was evaluated by the method described below. However, none of the steel sheets exhibited excellent ridging resistance.

In the invention disclosed in Patent Literature 2, the prestrain applied to evaluate ridging is not described. The inventors of the presently disclosed embodiments prepared various kinds of steel sheets by methods described in Patent Literature 2, and the ridging height that occurred when a prestrain of 23% was applied was evaluated by the ridging evaluation method described below. As a result, none of the steel sheets exhibited excellent ridging resistance. In addition, in this invention, the shape of the test piece used for evaluating elongation is not described. It is a well-known fact that the value of elongation obtained changes depending on the shape of the test piece used for evaluation.

The inventors of the presently disclosed embodiments prepared various kinds of steel sheets by methods described in Patent Literature 2, and the elongation after fracture of the steel sheets was evaluated by the tensile test method described below. As a result, none of the steel sheets exhibited excellent formability.

Furthermore, in the invention disclosed in Patent Literature 3, ridging evaluation is carried out on a test piece subjected to a prestrain of 20%, and ridging that occurs due to severer working is not sufficiently evaluated. The inventors of the presently disclosed embodiments prepared various kinds of steel sheets by methods described in Patent Literature 3, and the ridging height that occurred when a prestrain of 23% was applied was evaluated by the method described below. However, none of the steels exhibited excellent ridging resistance.

The disclosed embodiments have been developed under the current circumstances described above, and an object thereof is to provide a ferritic stainless steel sheet that has excellent corrosion resistance, formability, and ridging resistance, and a method for manufacturing the same.

Here, "excellent corrosion resistance" means that the rust area ratio measured by the method described below is 30% or less. Preferably, the rust area ratio is 20% or less. The corrosion test for evaluating the corrosion resistance is carried out in accordance with JASO M609-91. First, in the testing method, a test piece is polished with an emery paper to #600, washed with water, and ultrasonically degreased in ethanol for 5 minutes. Subsequently, a three-cycle corrosion test is carried out, each cycle consisting of salt spraying (5 mass % aqueous NaCl solution, 35° C.) 2 h→drying (60° C., relative humidity: 40%) 4 h→wetting (50° C., relative humidity: 95% or more) 2 h. After the test, the appearance of the corroded surface is photographed, and a 30 mm×30 mm region at the center of the test piece in the photographed image is subjected to image analysis to calculate the rust area ratio.

Furthermore, "excellent formability" means that the elongation after fracture of the steel sheet measured by the method described below is 28% or more. More preferably, the elongation after fracture is 32% or more. In order to evaluate the elongation after fracture, first, JIS No. 13B tensile test pieces are taken in accordance with JIS Z 2241 such that longitudinal directions thereof are, respectively, the rolling direction (L direction), a direction 45 degrees with respect to the rolling direction (D direction), and a direction 90 degrees with respect to the rolling direction (C direction). Subsequently, a tensile test is carried out in accordance with JIS Z 2241, and the elongation after fracture (El) is measured for each test piece. The three-direction average ((L+2D+C)/4, where L, D, and C respectively represent elongation after fracture (%) in the respective directions) of the obtained elongation after fracture is calculated, and is determined to be the elongation after fracture of the steel sheet.

Furthermore, "excellent ridging resistance" means that the ridging height of the steel sheet surface measured by the method described below is 3.0 μm or less. More preferably, the ridging height is 2.5 μm or less. Yet more preferably, the ridging height is 2.0 μm or less. To measure the ridging height of the steel sheet surface, first, a JIS No. 5 tensile test piece is taken in a direction parallel to the rolling direction. Next, after the surface of the test piece is polished with a #600 emery paper, a tensile strain of 23% is applied. Next, the surface profile is measured with a laser displacement meter in a direction 90 degrees with respect to the rolling direction on a polished surface of the parallel portion of the test piece. The measurement length is 16 mm per line, and the height is measured with 0.05 mm increments. In addition, the line interval is set to 0.1 mm, and a total of fifty lines are measured. The obtained profile data of each line is smoothed and subjected to a waviness removal process by using a Hanning window function-type finite impulse response (FIR) bandpass filter with a high-cut filter wavelength of 0.8 mm and a low-cut filter wavelength of 8 mm. Subsequently, on the basis of the processed profile data of each line, the data corresponding to 2 mm portions at both ends of each line is eliminated, and the arithmetic mean waviness, Wa, prescribed in JIS B 0601 (2001) is measured for each line. The average value of the values of the arithmetic mean waviness, Wa, of fifty lines is the ridging height of the steel sheet surface.

Note that, in the ridging resistance evaluation of the related art, test pieces subjected to a 15% or 20% tensile strain are mostly used. However, the assumption of the disclosed embodiments is that the steel sheet is formed into a shape more complex than that in the related art. Thus, the tensile strain applied to the test pieces is set to 23% for evaluation under the assumption that the steel sheet is formed more severely, in other words, is subjected to higher strain than in the related art.

Solution to Problem

To address the issues described above, the inventors of the disclosed embodiments have investigated a ferritic stainless steel having excellent corrosion resistance, formability, and ridging resistance, and a method for manufacturing the ferritic stainless steel. As a result, the following was found.

A ferritic stainless steel sheet having excellent formability and ridging resistance is obtained by hot-rolling and then annealing a ferritic stainless steel with an appropriate composition in a preferable temperature region that constitutes a ferrite-austenite two-phase region before cold-rolling, cold-rolling the resulting steel sheet, and then annealing the cold-rolled steel sheet for an appropriate time in an appropriate temperature range.

Specifically, in the steel composition, the C content is set to 0.030% or less, the Cr content is set to 14.4% or less, and the N content is set to 0.060% or less. A steel ingot having the aforementioned composition is hot-rolled, and the hot-rolled sheet is annealed at 900 to 1100° C., which is the ferrite-austenite two-phase region. In the disclosed embodiments, since the Cr content in the steel is sufficiently low, a sufficient amount of austenite phase is formed in the steel sheet during the hot-rolled sheet annealing. This austenite phase is transformed into a martensite phase during the cooling process that follows hot-rolled sheet annealing. In the subsequent cold-rolling, the hot-rolled and annealed sheet that contains the martensite phase is rolled, and thus, colonies (crystal grain groups having similar crystal orientations), which is the cause of ridging, are destroyed, and rolling strain is efficiently applied to the ferrite/martensite grain boundaries. In the subsequent cold-rolled sheet annealing, in the disclosed embodiments, since the rolling strain is efficiently applied as described above and since the Cr content, the C content, and the N content in the steel are sufficiently low, recrystallization is accelerated. By the recrystallization accelerating effect, the cold-rolled sheet is recrystallized sufficiently in the temperature range of 780 to 830° C., which is a ferrite single phase region, and a cold-rolled and annealed sheet having excellent formability is obtained. Furthermore, by the colony destroying effect described above, the cold-rolled and annealed sheet exhibits excellent ridging resistance.

The present disclosure is based on the aforementioned findings, and the exemplary embodiments are summarized as follows.

[1] A ferritic stainless steel sheet having a chemical composition containing, in terms of mass %, C: 0.005 to 0.030%,
Si: 0.05 to 1.00%,
Mn: 0.05 to 1.00%,
P: 0.040% or less,
S: 0.030% or less,
Al: 0.001 to 0.150%,
Cr: 10.8 to 14.4%,
Ni: 0.01 to 2.50%, and
N: 0.005 to 0.060%, with the balance being Fe and incidental impurities, in which an elongation after fracture is 28% or more, and a ridging height of a surface of a steel sheet to which a tensile strain of 23% has been applied in a rolling direction is 3.0 μm or less.

[2] The ferritic stainless steel sheet described in [1], further containing, in terms of mass %, one or two or more selected from Co: 0.01 to 0.50%,
Cu: 0.01 to 0.80%,
Mo: 0.01 to 0.30%, and
W: 0.01 to 0.50%.

[3] The ferritic stainless steel sheet described in [1] or [2], further containing, in terms of mass %, one or two or more selected from Ti: 0.01 to 0.30%, V: 0.01 to 0.10%, Zr: 0.01 to 0.10%, and Nb: 0.01 to 0.30%, in which a value of formula (1) below is 0.0 or less:

$$54\times(Ti+V+Zr+Nb)-5\times Mn-19\times Ni+1.0 \quad \text{formula (1)}$$

where, in formula (1) above, respective element symbols represent contents (mass %) of respective elements, or represent 0 when corresponding elements are not contained.

[4] The ferritic stainless steel sheet described in any one of [1] to [3], further containing, in terms of mass %, one or two or more selected from B: 0.0003 to 0.0030%, Mg: 0.0005 to 0.0100%, Ca: 0.0003 to 0.0030%, Y: 0.01 to 0.20%, and REM (rare earth metal): 0.001 to 0.100%.

[5] The ferritic stainless steel sheet described in any one of [1] to [4], further containing, in terms of mass %, one or two selected from Sn: 0.001 to 0.500% and Sb: 0.001 to 0.500%.

[6] A method for manufacturing the ferritic stainless steel sheet described in any one of [1] to [5], the method including:

a process of hot-rolling a steel slab having the chemical composition so as to form a hot-rolled sheet;

a process of performing hot-rolled sheet annealing that involves holding the hot-rolled sheet in a temperature range of 900° C. or more and 1100° C. or less for 5 seconds to 15 minutes so as to form a hot-rolled and annealed sheet;

a process of cold-rolling the hot-rolled and annealed sheet so as to form a cold-rolled sheet; and a process of performing cold-rolled sheet annealing that involves holding the cold-rolled sheet in a temperature range of 780° C. or more and 830° C. or less for 5 seconds to 5 minutes.

Advantageous Effects

The disclosed embodiments can provide a ferritic stainless steel sheet that has excellent corrosion resistance, formability, and ridging resistance.

DETAILED DESCRIPTION

The disclosed embodiments will now be specifically described.

A ferritic stainless steel sheet of the disclosed embodiments has a chemical composition containing, in terms of mass %, C: 0.005 to 0.030%, Si: 0.05 to 1.00%, Mn: 0.05 to 1.00%, P: 0.040% or less, S: 0.030% or less, Al: 0.001 to 0.150%, Cr: 10.8 to 14.4%, Ni: 0.01 to 2.50%, and N: 0.005 to 0.060%, with the balance being Fe and incidental impurities, in which an elongation after fracture is 28% or more, and a ridging height of a surface of a steel sheet to which a tensile strain of 23% has been applied in a rolling direction is 3.0 μm or less. The ferritic stainless steel sheet has excellent corrosion resistance, formability, and ridging resistance.

First, the reasons for limiting the chemical composition to the aforementioned ranges in the disclosed embodiments are described. Note that % indicating the unit of the content of a composition means mass % unless otherwise noted.

C: 0.005 to 0.030%

Carbon (C) is an element effective for increasing the strength of the steel. Furthermore, C is an element that improves ridging resistance since it promotes formation of the austenite phase during the hot-rolled sheet annealing. This effect is obtained at a C content of 0.005% or more. However, at a C content exceeding 0.030%, formability deteriorates due to an increase in the hardness of the steel. Thus, the C content is set to 0.005 to 0.030%. The C content is preferably 0.007% or more and more preferably 0.010% or more. The C content is preferably 0.020% or less and more preferably 0.015% or less.

Si: 0.05 to 1.00%

Silicon (Si) is an element useful as a deoxidant. This effect is obtained at a Si content of 0.05% or more. However, at a Si content exceeding 1.00%, formability deteriorates due to an increase in the hardness of the steel. Furthermore, since the amount of the austenite phase formed during the hot-rolled sheet annealing decreases, the ridging resistance deteriorates. Thus, the Si content is set to 0.05 to 1.00%. The Si content is preferably 0.07% or more, more preferably 0.10% or more, and yet more preferably 0.20% or more. The Si content is preferably 0.50% or less, more preferably less than 0.40%, and yet more preferably less than 0.30%.

Mn: 0.05 to 1.00%

Manganese (Mn) has a deoxidizing effect. Furthermore, Mn is an element that improves the ridging resistance since it promotes formation of the austenite phase during the hot-rolled sheet annealing. This effect is obtained at a Mn content of 0.05% or more. However, at a Mn content exceeding 1.00%, precipitation and coarsening of MnS are accelerated, and corrosion resistance deteriorates since MnS serves as a starting point of rust generation. Thus, the Mn content is set to 0.05 to 1.00%. The Mn content is preferably 0.10% or more and more preferably 0.15% or more. The Mn content is preferably 0.80% or less and more preferably 0.60% or less.

P: 0.040% or Less

Phosphorus (P) is an element that deteriorates corrosion resistance. Moreover, P segregates in crystal grain boundaries and deteriorates hot workability. Thus, the P content is preferably as low as possible, and is set to 0.040% or less. Preferably, the P content is 0.030% or less.

S: 0.030% or Less

Sulfur (S) forms a precipitate, MnS, with Mn. Since this MnS serves as a starting point of corrosion pitting, corrosion resistance deteriorates. Thus, the S content is preferably as low as possible, and is set to 0.030% or less. Preferably, the S content is 0.020% or less.

Al: 0.001 to 0.150%

Aluminum (Al) is an element effective for deoxidation. This effect is obtained at an Al content of 0.001% or more. However, at an Al content exceeding 0.150%, the formability deteriorates due to an increase in the hardness of the steel. Thus, the Al content is set to 0.001 to 0.150%. The Al content is preferably 0.005% or more and more preferably 0.010% or more. The Al content is preferably 0.100% or less and more preferably 0.050% or less.

Cr: 10.8 to 14.4%

Chromium (Cr) is an element that improves corrosion resistance by forming passive film. At a Cr content less than 10.8%, sufficient corrosion resistance is not obtained. Meanwhile, at a Cr content exceeding 14.4%, since the austenite phase is not formed sufficiently in the steel during the hot-rolled sheet annealing process, the ridging resistance deteriorates, and the formability deteriorates due to an increase in hardness of the steel. Thus, the Cr content is set to 10.8 to 14.4%. The Cr content is preferably 11.0% or more, more preferably 11.5% or more, and yet more preferably 12.0% or more. The Cr content is preferably 14.0% or less, more preferably 13.5% or less, and yet more preferably 13.0% or less.

Ni: 0.01 to 2.50%

Nickel (Ni) is an element that suppresses active dissolution in a low pH environment. In a so-called crevice structure, in which steel sheets are overlapped each other, a low pH environment, that easily causes corrosion, is sometimes formed. Furthermore, in cases other than the crevice structure formed between the steel sheets as described above, an aqueous solution containing chloride ions, that cause rusting of steel sheets, may condense on the steel sheets, salt may precipitate from the aqueous solution, and a crevice structure may be formed between the precipitated salt and the steel sheet such that a low pH environment that easily causes corrosion is formed. Ni suppresses progress of corrosion in such environments, and improves corrosion resistance of the steel. In other words, Ni is highly effective for improving the crevice corrosion resistance, suppresses progress of corrosion in an active dissolution state markedly, and thereby improves corrosion resistance. Furthermore, Ni is an element that improves ridging resistance since it promotes formation of the austenite phase during the hot-rolled sheet annealing.

This effect is obtained at a Ni content of 0.01% or more. However, at a Ni content exceeding 2.50%, formability deteriorates due to an increase in the hardness of the steel. Thus, the Ni content is set to 0.01 to 2.50%. The Ni content is preferably 0.03% or more, more preferably 0.05% or more, and yet more preferably 0.10% or more. The Ni content is preferably 1.20% or less, more preferably 0.80% or less, and yet more preferably 0.25% or less.

N: 0.005 to 0.060%

Nitrogen (N) is an element effective for increasing the strength of the steel. Furthermore, nitrogen is an element that improves ridging resistance since it promotes formation of the austenite phase during the hot-rolled sheet annealing. This effect is obtained at a N content of 0.005% or more. However, at a N content exceeding 0.060%, formability of the steel deteriorates due to an increase in the hardness of the steel. Thus, the N content is set to 0.005 to 0.060%. The N content is preferably 0.007% or more and more preferably 0.010% or more. The N content is preferably 0.020% or less and more preferably 0.015% or less.

The balance other than the elements described above is Fe and incidental impurities. Representative examples of the incidental impurities include O (oxygen), Zn, Ga, Ge, As, Ag, In, Hf, Ta, Re, Os, Ir, Pt, Au, and Pb. Among these elements, O (oxygen) can be contained in an amount of 0.02% or less. A total of 0.1% or less of other elements can be contained.

In the disclosed embodiments, the following elements may be contained as appropriate in addition to the basic components described above.

Co: 0.01 to 0.50%

Cobalt (Co) is an element that improves crevice corrosion resistance of stainless steel. However, excessively containing Co results in saturated effects and deterioration of the workability. Thus, if Co is to be contained, the Co content is preferably 0.01 to 0.50%. The Co content is more preferably 0.30% or less and yet more preferably 0.10% or less.

Cu: 0.01 to 0.80%

Copper (Cu) is an element that improves corrosion resistance by strengthening the passive film. However, excessively containing Cu results in saturated effects and deterioration of the workability; furthermore, ε-Cu tends to precipitate and the corrosion resistance deteriorates. Thus, if Cu is to be contained, the Cu content is preferably 0.01 to 0.80%. The Cu content is more preferably 0.15% or more and yet more preferably 0.40% or more. The Cu content is more preferably 0.60% or less and yet more preferably 0.45% or less.

Mo: 0.01 to 0.30%

Molybdenum (Mo) has an effect of improving crevice corrosion resistance of stainless steel. However, excessively containing Mo results in saturated effects and deterioration of the workability. Thus, if Mo is to be contained, the Mo content is preferably 0.01 to 0.30%. The Mo content is more preferably 0.20% or less and yet more preferably 0.10% or less.

W: 0.01 to 0.50%

Tungsten (W) is an element that improves crevice corrosion resistance of stainless steel. However, excessively containing W results in saturated effects and deterioration of the workability. Thus, if W is to be contained, the W content is preferably 0.01 to 0.50%. The W content is more preferably 0.03% or more and yet more preferably 0.05% or more. The W content is more preferably 0.30% or less and yet more preferably 0.10% or less.

Ti: 0.01 to 0.30%

Titanium (Ti) is an element that has an effect of improving formability of the cold-rolled and annealed sheet since its precipitation as carbides or nitrides during hot rolling due to its high affinity to C and N decreases the amounts of dissolved C and dissolved N in the base metal. Meanwhile, excessively containing Ti deteriorates the ridging resistance since it suppresses formation of the austenite phase during the hot-rolled sheet annealing. Thus, if Ti is to be contained, the Ti content is preferably 0.01 to 0.30%. More preferably, the Ti content is 0.02% or more. The Ti content is more preferably 0.10% or less and yet more preferably 0.08% or less.

V: 0.01 to 0.10%

Vanadium (V) is an element that has an effect of improving formability of the cold-rolled and annealed sheet since its precipitation as carbides or nitrides during hot rolling due to its high affinity to C and N decreases the amounts of dissolved C and dissolved N in the base metal. Meanwhile, excessively containing V deteriorates the ridging resistance since it suppresses formation of the austenite phase during the hot-rolled sheet annealing. Thus, if V is to be contained, the V content is preferably 0.01 to 0.10%. The V content is more preferably 0.02% or more and yet more preferably 0.03% or more. The V content is more preferably 0.08% or less and yet more preferably 0.05% or less.

Zr: 0.01 to 0.10%

Zirconium (Zr) is an element that has an effect of improving formability of the cold-rolled and annealed sheet since its precipitation as carbides or nitrides during hot rolling due to its high affinity to C and N decreases the amounts of dissolved C and dissolved N in the base metal. Meanwhile, excessively containing Zr deteriorates the ridging resistance since it suppresses formation of the austenite phase during the hot-rolled sheet annealing. Thus, if Zr is to be contained, the Zr content is preferably 0.01 to 0.10%. The Zr content is more preferably 0.02% or more and yet more preferably 0.03% or more. The Zr content is more preferably 0.08% or less and yet more preferably 0.05% or less.

Nb: 0.01 to 0.30%

Niobium (Nb) is an element that has an effect of improving formability of the cold-rolled and annealed sheet since its precipitation as carbides or nitrides during hot rolling due to its high affinity to C and N decreases the amounts of dissolved C and dissolved N in the base metal. Meanwhile, excessively containing Nb deteriorates the ridging resistance since it suppresses formation of the austenite phase during the hot-rolled sheet annealing. Thus, if Nb is to be contained, the Nb content is preferably 0.01 to 0.30%. More preferably, the Nb content is 0.02% or more. The Nb content is more preferably 0.10% or less and yet more preferably 0.08% or less.

When one or two or more selected from Ti, V, Zr, and Nb is contained, the value of formula (1) below is 0.0 or less.

$$54\times(Ti+V+Zr+Nb)-5\times Mn-19\times Ni+1.0 \quad \text{formula (1)}$$

In formula (1), respective element symbols represent contents (mass %) of respective elements, or represent 0 when corresponding elements are not contained.

In embodying the disclosed embodiments, when one or two or more selected from Ti, V, Zr, and Nb is contained, the contents of the respective elements must satisfy the aforementioned ranges and the value of formula (1) above must be 0.0 or less in order to obtain excellent ridging resistance.

As mentioned above, Ti, V, Zr, and Nb have an effect of suppressing formation of the austenite phase during the hot-rolled sheet annealing process. Meanwhile, even when these elements are contained, by sufficiently increasing the contents of Mn and Ni that promote formation of the austenite phase, a sufficient amount of austenite phase can be formed in the steel during the hot-rolled sheet annealing process.

In other words, when one or two or more selected from Ti, V, Zr, and Nb is contained, the steel composition is adjusted so that the value of formula (1) is 0.0 or less. In this manner, it becomes possible to form a sufficient amount of austenite phase in the hot-rolled sheet during the hot-rolled sheet annealing and thus a sufficient amount of martensite phase can exist in the hot-rolled and annealed sheet. Thus, colonies can be sufficiently destroyed in the cold-rolling process, and excellent ridging resistance can be given to the cold-rolled and annealed sheet. However, when the value of formula (1) exceeds 0.0, a sufficient amount of austenite phase is not formed in the hot-rolled sheet during the hot-rolled sheet annealing, the hot-rolled and annealed sheet does not include a sufficient amount of martensite phase, destruction of colonies becomes insufficient during the cold rolling process, and the ridging resistance of the cold-rolled and annealed sheet deteriorates.

B: 0.0003 to 0.0030%

Boron (B) is an element effective for preventing low-temperature secondary work embrittlement. However, excessively containing B results in deterioration of hot workability. Thus, if B is to be contained, the B content is preferably 0.0003 to 0.0030%. More preferably, the B content is 0.0005% or more. More preferably, the B content is 0.0020% or less.

Mg: 0.0005 to 0.0100%

Magnesium (Mg) acts as a deoxidant by forming Mg oxides with Al in molten steel. However, excessively containing Mg results in deterioration of toughness of the steel and decreases the productivity. Thus, if Mg is to be contained, the Mg content is preferably 0.0005 to 0.0100%. More preferably, the Mg content is 0.0010% or more. The Mg content is more preferably 0.0050% or less and yet more preferably 0.0030% or less.

Ca: 0.0003 to 0.0030%

Calcium (Ca) is an element that improves hot workability. However, excessively containing Ca results in deterioration of toughness of the steel, decreases the productivity, and, furthermore, deteriorates corrosion resistance due to precipitation of CaS. Thus, if Ca is to be contained, the Ca content is preferably 0.0003 to 0.0030%. More preferably, the Ca content is 0.0010% or more. More preferably, the Ca content is 0.0020% or less.

Y: 0.01 to 0.20%

Yttrium (Y) is an element that decreases the viscosity of the molten steel and improves cleanliness. However, excessively containing Y results in saturated effects and deterioration of the workability. Thus, if Y is to be contained, the Y content is preferably 0.01 to 0.20%. More preferably, the Y content is 0.10% or less.

REM (Rare Earth Metal): 0.001 to 0.100%

Rare earth metals (REM: elements of atomic numbers 57 to 71 such as La, Ce, and Nd) are elements that improve high-temperature oxidation resistance. However, excessively containing REM results in saturated effects, causes surface defects during hot-rolling, and decreases productivity. Thus, if REM is to be contained, the REM content is preferably 0.001 to 0.100%. More preferably, the REM content is 0.005% or more. More preferably, the REM content is 0.05% or less.

Sn: 0.001 to 0.500%

Tin (Sn) is effective for improving ridging resistance by promoting formation of the deformation band during rolling. However, excessively containing Sn results in saturated effects and deterioration of the formability. Thus, if Sn is to be contained, the Sn content is preferably 0.001 to 0.500%. More preferably, the Sn content is 0.003% or more. More preferably, the Sn content is 0.200% or less.

Sb: 0.001 to 0.500%

Antimony (Sb) is effective for improving ridging resistance by promoting formation of the deformation band during rolling. However, excessively containing Sb results in saturated effects and deterioration of the formability. Thus, if Sb is to be contained, the Sb content is preferably 0.001 to 0.500%. More preferably, the Sb content is 0.003% or more. More preferably, the Sb content is 0.200% or less.

Next, a preferable method for manufacturing a ferritic stainless steel sheet of the disclosed embodiments is described. A steel having the above-described chemical composition is melted by a known method that uses a converter, an electric furnace, a vacuum melting furnace, or the like, and prepared into a steel (steel slab) by a continuous casting method or an ingoting-slabbing method. After this slab is heated to 1000° C. or more and 1200° C. or less, the heated slab is hot-rolled to a sheet thickness of 2.0 to 6.0 mm under the condition that the finishing temperature is 700° C. or more and 1000° C. or less. Hot-rolled sheet annealing that involves holding the hot-rolled sheet obtained as mentioned above in the temperature range of 900° C. or more and 1100° C. or less for 5 seconds to 15 minutes is performed, the resulting annealed sheet is pickled and cold-rolled, and cold-rolled sheet annealing that involves holding the cold-rolled sheet in a temperature range of 780° C. or more and 830° C. or less for 5 seconds to 5 minutes is performed in a continuous annealing line. After cold-rolled sheet annealing, pickling is performed in a pickling line to remove the scale. The cold-rolled, annealed, and pickled sheet from which scale is removed may be subjected to skinpass rolling.

Process of performing hot-rolled sheet annealing that involves holding the hot-rolled sheet in a temperature range of 900° C. or more and 1100° C. or less for 5 seconds to 15 minutes so as to form a hot-rolled and annealed sheet When the hot-rolled sheet annealing temperature is less than 900° C., annealing is performed in the ferrite single phase region or a temperature region close thereto, and as a result a sufficient amount of austenite phase is not formed in the hot-rolled sheet. Meanwhile, when the hot-rolled sheet annealing temperature exceeds 1100° C., annealing is also performed in the ferrite single phase region or a temperature region close thereto, and as a result a sufficient amount of austenite phase is not formed in the hot-rolled sheet.

In addition, when the holding time during hot-rolled sheet annealing is less than 5 seconds, a sufficient amount of austenite phase is not formed in the hot-rolled sheet during the hot-rolled sheet annealing. In contrast, when the holding time in the hot-rolled sheet annealing exceeds 15 minutes, the crystal grains coarsen during the hot-rolled sheet annealing, which results in coarsening of crystal grains of a cold-rolled and annealed sheet obtained by subsequent cold-rolling and annealing. Such a structure causes surface roughening known as orange peel, which is different from ridging, during forming.

Thus, in the disclosed embodiments, hot-rolled sheet annealing is performed by holding the hot-rolled sheet in a temperature range of 900° C. or more and 1100° C. or less for 5 seconds to 15 minutes to obtain a hot-rolled and annealed sheet. The hot-rolled sheet annealing is preferably performed in a temperature range of 950° C. or more. The hot-rolled sheet annealing is preferably performed in a temperature range of 1050° C. or less. The hot-rolled sheet annealing preferably involves holding the sheet in the aforementioned temperature range for 20 seconds or more. The hot-rolled sheet annealing preferably involves holding the sheet in the aforementioned temperature range for 1 minute or less.

Subsequently, the hot-rolled and annealed sheet is cold-rolled to prepare a cold-rolled sheet. The cold rolling conditions are not particularly limited, and a common method may be employed. For example, in cold-rolling, the total rolling reduction can be 40 to 90%.

Process of performing cold-rolled sheet annealing that involves holding the cold-rolled sheet in a temperature range of 780° C. or more and 830° C. or less for 5 seconds to 5 minutes When the cold-rolled sheet annealing temperature is less than 780° C., the unrecrystallized structure remains in the steel sheet, and as a result sufficient formability is not obtained. When the cold-rolled sheet annealing temperature is more than 830° C., the martensite phase exists in the structure after annealing due to the formation of the austenite phase in the steel during annealing with result that sufficient formability is not obtained. Moreover, when the holding time in the cold-rolled sheet annealing is less than 5 seconds, the martensite phase contained in the cold-rolled sheet partly remains undecomposed, the martensite phase exists in the structure after annealing, and as a result sufficient formability is not obtained.

When the holding time in cold-rolled sheet annealing is more than 5 minutes, crystal grains coarsen during the cold-rolled sheet annealing, therefore surface roughening known as orange peel, which is different from ridging, occurs during forming of the steel sheet after cold-rolling and annealing.

Thus, in the disclosed embodiments, cold-rolled sheet annealing that involves holding the cold-rolled sheet in a temperature range of 780° C. or more and 830° C. or less for 5 seconds to 5 minutes is performed. The cold-rolled sheet annealing is preferably performed in a temperature range of 790° C. or more. The cold-rolled sheet annealing is preferably performed in a temperature range of 810° C. or less. The cold-rolled sheet annealing preferably involves holding the sheet in the aforementioned temperature range for 20 seconds or more. The cold-rolled sheet annealing preferably involves holding the sheet in the aforementioned temperature range for 1 minute or less.

Example 1

Each of ferritic stainless steels having chemical compositions (the balance being Fe and incidental impurities) indicated in Nos. 1-1 to 1-3 in Table 1 was prepared into a 100 kg steel ingot, and then hot-rolled under heating at a temperature of 1050° C. so as to obtain a hot-rolled sheet having a thickness of 4.0 mm.

Each of the hot-rolled sheets was divided into five, and four of these were annealed in air for 20 seconds at respective temperatures of 830 to 1200° C. indicated in Table 1 to prepare hot-rolled and annealed sheets, and top and bottom surfaces were ground to remove scale to prepare raw materials for cold rolling.

The remaining one of the divided pieces of each hot-rolled sheet was annealed in an air atmosphere at 800° C. for 8 hours to prepare a hot-rolled and annealed sheet, and top and bottom surfaces were ground to remove scale to prepare a raw material for cold rolling.

Each of the obtained raw materials for cold rolling was cold-rolled to prepare a cold-rolled sheet having a thickness of 1.0 mm. The obtained cold-rolled sheets were annealed in an air atmosphere at 800° C. for 20 seconds to obtain cold-rolled and annealed sheets. The obtained cold-rolled and annealed sheets were pickled by a common method to obtain cold-rolled, annealed, and pickled ferritic stainless steel sheets.

<Corrosion Resistance>

From each of the manufactured cold-rolled, annealed, and pickled sheets, a 80 mm (length)×60 mm (width) steel sheet was cut out by shearing, the surface thereof was polished with an emery polishing paper to #600, and, after washing with water, the steel sheet was ultrasonically degreased for 5 minutes in ethanol to obtain a test piece. A corrosion test according to JASO M609-91 was performed on the obtained test piece to evaluate corrosion resistance. After end portions and the bottom surface of a test piece were covered with a vinyl tape, the test piece was placed in a tester with a slope of 600 and with the lengthwise direction being set in the vertical direction. A three-cycle test was carried out, each cycle consisting of salt spraying (5 mass % aqueous NaCl solution, 35° C.) 2 h→drying (60° C., relative humidity: 40%) 4 h→wetting (50° C., relative humidity: 95% or more) 2 h. After the test, the appearance of the corroded surface was photographed, and a 30 mm×30 mm region at the center of the test piece in the photographed image was subjected to image analysis to calculate the rust area ratio. Samples with a rust area ratio of 20% or less were evaluated as "○" (pass, excellent) samples with a rust area ratio exceeding 20% but not exceeding 30% were evaluated as "□" (pass), and samples with a rust area ratio exceeding 30% were evaluated as "▲" (fail).

<Formability>

From each of the manufactured cold-rolled, annealed, and pickled sheets, a JIS No. 13B tensile test piece was taken in accordance with JIS Z 2241 such that longitudinal directions thereof were, respectively, the rolling direction (L direction), a direction 45 degrees with respect to the rolling direction (D direction), and a direction 90 degrees with respect to the rolling direction (C direction), and a tensile test was performed at room temperature according to the same standard to evaluate the formability. Samples having a three-direction average ((L+2D+C)/4 where L, D, and C represent elongations after fracture (%) of respective directions) of total elongation after fracture (%) of 32% or more were evaluated as "○" (pass, excellent), samples with an average of less than 32% but not less than 28% were evaluated as "□" (pass), and samples with an average of less than 28% were evaluated as "▲" (fail)

<Ridging Resistance>

Furthermore, from each of the manufactured cold-rolled, annealed, and pickled sheets, a JIS No. 5 test piece specified in JIS Z 2241 was taken so that the rolling direction was the longitudinal direction of the test piece, and, after the surface thereof was polished with a #600 emery paper, a tensile test was performed in accordance with the same standard to apply a tensile strain of 23%. Subsequently, the surface profile was measured with a laser displacement meter in a direction 90 degrees with respect to the rolling direction on a polished surface at the center of the parallel portion of the test piece. The measurement length was 16 mm per line, and the height was measured with 0.05 mm increments. The obtained profile data was smoothed and subjected to a waviness removal process by using a Hanning window function-type finite impulse response (FIR) bandpass filter with a high-cut filter wavelength of 0.8 mm and a low-cut filter wavelength of 8 mm.

Subsequently, on the basis of the processed profile data of each line, the data corresponding to 2 mm portions at both ends of each lines was eliminated, and the arithmetic mean waviness, Wa, specified in JIS B 0601 (2001) was measured for each line. Note that the line interval was set to 0.1 mm, and a total of fifty lines were measured. The average of the values of the arithmetic mean waviness, Wa, of fifty lines was used as the ridging height of the steel sheet surface, and the ridging resistance was evaluated.

The case in which the ridging height was 2.0 μm or less was evaluated as "◇" (pass, particularly excellent), the case in which the ridging height was more than 2.0 μm but not more than 2.5 μm was evaluated as "○" (pass, excellent), the case in which the ridging height was more than 2.5 μm but not more than 3.0 μm was evaluated as "□" (pass), and the case in which the ridging height was more than 3.0 μm was evaluated as "▲" (fail).

The obtained results are indicated in Table 1. The examples in which hot-rolled sheet annealing that involved holding a hot-rolled sheet in a temperature range of 900° C. or more and 1100° C. or less for 5 seconds to 15 minutes was performed were evaluated as "○" or "□" for corrosion resistance, "○" for formability, and "◇" or "○" for ridging resistance, indicating excellent corrosion resistance as well as excellent formability and ridging resistance.

For any chemical composition of the steel, comparative examples in which the hot-rolled sheet annealing temperature was less than 900° C. or was more than 1100° C. had poor ridging resistance since the raw material for cold rolling did not contain a sufficient area fraction of the martensite phase and thus colonies were not disrupted by cold rolling.

TABLE 1

| Test No. | Chemical composition (mass %) | | | | | | | | | | Hot-rolled sheet annealing conditions |
|---|---|---|---|---|---|---|---|---|---|---|---|
| | C | Si | Mn | P | S | Al | Cr | Ni | N | Other elements | Temperature (° C.) |
| 1-1 | 0.008 | 0.37 | 0.20 | 0.016 | 0.005 | 0.016 | 13.3 | 0.25 | 0.010 | — | 800 |
| | | | | | | | | | | | 850 |
| | | | | | | | | | | | 900 |
| | | | | | | | | | | | 1000 |
| | | | | | | | | | | | 1150 |
| 1-2 | 0.015 | 0.15 | 0.23 | 0.019 | 0.003 | 0.042 | 12.4 | 0.82 | 0.005 | — | 800 |
| | | | | | | | | | | | 830 |
| | | | | | | | | | | | 900 |
| | | | | | | | | | | | 1050 |
| | | | | | | | | | | | 1200 |
| 1-3 | 0.019 | 0.43 | 0.52 | 0.024 | 0.006 | 0.003 | 11.5 | 0.12 | 0.013 | — | 800 |
| | | | | | | | | | | | 840 |
| | | | | | | | | | | | 900 |
| | | | | | | | | | | | 1100 |
| | | | | | | | | | | | 1200 |

| Test No. | Hot-rolled sheet annealing conditions Time | Evaluation results of cold-rolled, annealed, and pickled sheet: Corrosion resistance | Formability | Ridging resistance | Remarks |
|---|---|---|---|---|---|
| 1-1 | 8 hr | ○ | ○ | ▲ | Comparative Example |
| | 20 S | ○ | ○ | ▲ | Comparative Example |
| | 20 S | ○ | ○ | ○ | Example |
| | 20 S | ○ | ○ | ○ | Example |
| | 20 S | ○ | ○ | ▲ | Comparative Example |
| 1-2 | 8 hr | ○ | ○ | ▲ | Comparative Example |
| | 20 S | ○ | ○ | ▲ | Comparative Example |
| | 20 S | ○ | ○ | ◇ | Example |
| | 20 S | ○ | ○ | ◇ | Example |
| | 20 S | ○ | ○ | ▲ | Comparative Example |
| 1-3 | 8 hr | □ | ○ | ▲ | Comparative Example |

TABLE 1-continued

| | | | | |
|---|---|---|---|---|
| 20 S | □ | ○ | ▲ | Comparative Example |
| 20 S | □ | ○ | ◇ | Example |
| 20 S | □ | ○ | ◇ | Example |
| 20 S | □ | ○ | ▲ | Comparative Example |

* The balance other than the above-described chemical composition is Fe and incidental impurities.

*[Hot-rolled sheet annealing time] In examples involving 800° C., annealing was performed for 8 hours in a batch annealing furnace, and in examples not involving 800° C., annealing was performed for 20 seconds in a continuous annealing furnace.
*[Corrosion resistance] After three corrosion test cycles, samples with a rust area ratio of 20% or less were evaluated as "○" (pass, excellent), samples with a rust area ratio exceeding 20% but not exceeding 30% were evaluated as (pass), and samples with a rust area ratio exceeding 30% were evaluated as "▲" (fail).
*[Formability] A tensile test was performed at room temperature, and samples having a three-direction average of total elongation after fracture (%) of 32% or more were evaluated as "○" (pass, excellent), samples with an average of less than 32% but not less than 28% were evaluated as "□" (pass), and samples with an average of less than 28% were evaluated as "▲" (fail).
*[Ridging resistance] After 23% tensile strain was applied, the case in which the ridging height on the surface of the center of the parallel portion of a test specimen was 2.0 μm or less was evaluated as "○" (pass, particularly excellent), the case in which the ridging height was more than 2.0 μ m but not more than 2.5 μm was evaluated as "○" (pass, excellent), the case in which the ridging height was more than 2.5 μm but not more than 3.0 μm was evaluated as "□" (pass), and the case in which the ridging height was more than 3.0 μm was evaluated as "▲" (fail).
* Underlines indicate items outside the scope of the disclosed embodiments.

Example 2

Cold-rolled, annealed, and pickled sheets having chemical compositions indicated in Nos. 2-1 to 2-57 in Tables 2-1 and 2-2 were manufactured under the conditions indicated in Example 1. However, for the hot-rolled sheet annealing conditions, annealing was performed in an air atmosphere at 1000° C. for 20 seconds. These cold-rolled, annealed, and pickled sheets were subjected to the tests indicated in Example 1, and corrosion resistance, formability, and ridging resistance were evaluated.

The obtained results are indicated in Tables 2-1 and 2-2.

TABLE 2-1

| | Chemical composition (mass %) | | | | | | | | | |
|---|---|---|---|---|---|---|---|---|---|---|
| Test No. | C | Si | Mn | P | S | Al | Cr | Ni | N | Other elements |
| 2-1 | 0.005 | 0.37 | 0.24 | 0.017 | 0.005 | 0.016 | 11.1 | 0.21 | 0.008 | — |
| 2-2 | 0.020 | 0.45 | 0.54 | 0.022 | 0.006 | 0.002 | 11.5 | 0.09 | 0.011 | — |
| 2-3 | 0.007 | 0.31 | 0.20 | 0.018 | 0.007 | 0.011 | 11.7 | 0.15 | 0.010 | — |
| 2-4 | 0.012 | 0.36 | 0.17 | 0.016 | 0.007 | 0.007 | 12.5 | 0.16 | 0.006 | — |
| 2-5 | 0.014 | 0.31 | 0.21 | 0.021 | 0.007 | 0.025 | 13.2 | 0.18 | 0.005 | — |
| 2-6 | 0.015 | 0.35 | 0.15 | 0.019 | 0.004 | 0.038 | 14.4 | 0.18 | 0.011 | — |
| 2-7 | 0.005 | 0.34 | 0.16 | 0.020 | 0.004 | 0.019 | 12.9 | 0.03 | 0.008 | — |
| 2-8 | 0.007 | 0.26 | 0.15 | 0.020 | 0.007 | 0.001 | 12.7 | 0.07 | 0.008 | — |
| 2-9 | 0.014 | 0.30 | 0.20 | 0.015 | 0.006 | 0.028 | 12.5 | 0.12 | 0.010 | — |
| 2-10 | 0.005 | 0.22 | 0.19 | 0.020 | 0.006 | 0.030 | 12.9 | 0.77 | 0.007 | — |
| 2-11 | 0.014 | 0.31 | 0.19 | 0.018 | 0.005 | 0.014 | 12.6 | 2.46 | 0.005 | — |
| 2-12 | 0.018 | 0.39 | 0.24 | 0.017 | 0.006 | 0.030 | 13.5 | 0.21 | 0.013 | — |
| 2-13 | 0.029 | 0.29 | 0.18 | 0.023 | 0.007 | 0.026 | 12.9 | 0.17 | 0.014 | — |
| 2-14 | 0.015 | 0.37 | 0.24 | 0.023 | 0.004 | 0.018 | 13.2 | 0.19 | 0.019 | — |
| 2-15 | 0.006 | 0.22 | 0.22 | 0.024 | 0.004 | 0.024 | 12.5 | 0.17 | 0.057 | — |
| 2-16 | 0.006 | 0.07 | 0.18 | 0.020 | 0.007 | 0.029 | 12.9 | 0.23 | 0.008 | — |
| 2-17 | 0.006 | 0.48 | 0.21 | 0.021 | 0.004 | 0.003 | 13.1 | 0.10 | 0.009 | — |
| 2-18 | 0.013 | 0.95 | 0.18 | 0.024 | 0.005 | 0.019 | 12.8 | 0.20 | 0.014 | — |
| 2-19 | 0.009 | 0.30 | 0.08 | 0.015 | 0.005 | 0.031 | 13.4 | 0.20 | 0.007 | — |
| 2-20 | 0.012 | 0.29 | 0.76 | 0.024 | 0.006 | 0.021 | 12.7 | 0.22 | 0.008 | — |
| 2-21 | 0.013 | 0.35 | 0.96 | 0.023 | 0.006 | 0.014 | 12.6 | 0.16 | 0.007 | — |
| 2-22 | 0.012 | 0.32 | 0.23 | 0.019 | 0.006 | 0.024 | 13.3 | 0.24 | 0.013 | Cu: 0.42 |
| 2-23 | 0.005 | 0.29 | 0.16 | 0.016 | 0.005 | 0.025 | 13.4 | 0.20 | 0.008 | Mo: 0.06 |
| 2-24 | 0.007 | 0.38 | 0.22 | 0.024 | 0.008 | 0.005 | 13.5 | 0.24 | 0.006 | Ti: 0.04 |
| 2-25 | 0.012 | 0.33 | 0.17 | 0.024 | 0.004 | 0.007 | 12.9 | 0.22 | 0.013 | Nb: 0.05 |
| 2-26 | 0.008 | 0.28 | 0.21 | 0.021 | 0.006 | 0.015 | 12.9 | 0.15 | 0.010 | Sn: 0.005 |
| 2-27 | 0.009 | 0.29 | 0.23 | 0.022 | 0.006 | 0.018 | 12.6 | 0.24 | 0.009 | Co: 0.03, W: 0.07 |
| 2-28 | 0.009 | 0.25 | 0.17 | 0.015 | 0.005 | 0.016 | 12.6 | 0.21 | 0.006 | V: 0.04, Mg: 0.0021 |
| 2-29 | 0.005 | 0.22 | 0.21 | 0.023 | 0.008 | 0.010 | 12.9 | 0.11 | 0.005 | Sn: 0.008, Sb: 0.010 |
| 2-30 | 0.008 | 0.33 | 0.25 | 0.023 | 0.006 | 0.024 | 12.9 | 0.18 | 0.006 | Cu: 0.22, Y: 0.04, La: 0.05 |
| 2-31 | 0.011 | 0.24 | 0.16 | 0.015 | 0.006 | 0.037 | 12.9 | 0.11 | 0.015 | Ca: 0.0014, Ce: 0.02, Sn: 0.121 |
| 2-32 | 0.007 | 0.31 | 0.17 | 0.025 | 0.005 | 0.003 | 12.5 | 0.24 | 0.015 | Mo: 0.15, Zr: 0.05, Sb: 0.248 |
| 2-33 | 0.010 | 0.31 | 0.23 | 0.019 | 0.005 | 0.026 | 12.9 | 0.17 | 0.014 | W: 0.18, B: 0.0011, Sn: 0.195 |
| 2-34 | 0.007 | 0.29 | 0.18 | 0.022 | 0.005 | 0.037 | 12.8 | 0.21 | 0.009 | Ti: 0.03, Nb: 0.04 |

| | | Evaluation results of cold-rolled, annealed, and pickled sheet | | | |
|---|---|---|---|---|---|
| Test No. | Formula (1) | Corrosion resistance | Formability | Ridging resistance | Remarks |
| 2-1 | — | □ | ○ | ◇ | Example |
| 2-2 | — | □ | ○ | ◇ | Example |
| 2-3 | — | □ | ○ | ◇ | Example |
| 2-4 | — | ○ | ○ | ◇ | Example |

TABLE 2-1-continued

| | | | | | |
|---|---|---|---|---|---|
| 2-5 | — | ○ | ○ | ○ | Example |
| 2-6 | — | ○ | □ | □ | Example |
| 2-7 | — | ○ | ○ | ◇ | Example |
| 2-8 | — | ○ | ○ | ◇ | Example |
| 2-9 | — | ○ | ○ | ◇ | Example |
| 2-10 | — | ○ | ○ | ◇ | Example |
| 2-11 | — | ○ | ○ | ◇ | Example |
| 2-12 | — | ○ | ○ | ○ | Example |
| 2-13 | — | ○ | ○ | ◇ | Example |
| 2-14 | — | ○ | ○ | ○ | Example |
| 2-15 | — | ○ | ○ | ◇ | Example |
| 2-16 | — | ○ | ○ | ◇ | Example |
| 2-17 | — | ○ | ○ | ○ | Example |
| 2-18 | — | ○ | ○ | ◇ | Example |
| 2-19 | — | ○ | ○ | ○ | Example |
| 2-20 | — | ○ | ○ | ◇ | Example |
| 2-21 | — | ○ | ○ | ◇ | Example |
| 2-22 | — | ○ | ○ | ○ | Example |
| 2-23 | — | ○ | ○ | ○ | Example |
| 2-24 | −2.5 | ○ | ○ | ○ | Example |
| 2-25 | −1.3 | ○ | ○ | ◇ | Example |
| 2-26 | — | ○ | ○ | ◇ | Example |
| 2-27 | — | ○ | ○ | ◇ | Example |
| 2-28 | −1.7 | ○ | ○ | ◇ | Example |
| 2-29 | — | ○ | ○ | ◇ | Example |
| 2-30 | — | ○ | ○ | ◇ | Example |
| 2-31 | — | ○ | ○ | ◇ | Example |
| 2-32 | −1.7 | ○ | ○ | ◇ | Example |
| 2-33 | — | ○ | ○ | ◇ | Example |
| 2-34 | −0.1 | ○ | ○ | ◇ | Example |

* The balance other than the above-described chemical composition is Fe and incidental impurities.

*[Corrosion resistance] After three corrosion test cycles, samples with a rust area ratio of 20% or less were evaluated as "○" (pass, excellent), samples with a rust area ratio exceeding 20% but not exceeding 30% were evaluated as "□" (pass), and samples with a rust area ratio exceeding 30% were evaluated as "▲" (fail).

*[Formability] A tensile test was performed at room temperature, and samples having a three-direction average of total elongation after fracture (%) of 32% or more were evaluated as "○" (pass, excellent), samples with an average of less than 32% but not less than 28% were evaluated as "□" (pass), and samples with an average of less than 28% were evaluated as "▲" (fail).

*[Ridging resistance] After 23% tensile strain was applied, the case in which the ridging height on the surface of the center of the parallel portion of a test specimen was 2.0 μm or less was evaluated as "◇" (pass, particularly excellent), the case in which the ridging height was more than 2.0 μ m but not more than 2.5 μm was evaluated as "○" (pass, excellent), the case in which the ridging height was more than 2.5 μm but not more than 3.0 μm was evaluated as "□" (pass), and the case in which the ridging height was more than 3.0 μm was evaluated as "▲" (fail).

*[Formula (1)] 54 × (Ti + V + Zr + Nb) − 5 × Mn − 19 × Ni + 1.0 where the respective element symbols represent the contents (mass %) of the respective elements and represent 0 when the corresponding elements are not contained.

* Underlines indicate items outside the scope of the disclosed embodiments.

TABLE 2-2

| | Chemical composition (mass %) | | | | | | | | | |
|---|---|---|---|---|---|---|---|---|---|---|
| Test No. | C | Si | Mn | P | S | Al | Cr | Ni | N | Other elements |
| 2-35 | 0.012 | 0.33 | 0.22 | 0.017 | 0.005 | 0.026 | 10.6 | 0.18 | 0.008 | — |
| 2-36 | 0.005 | 0.22 | 0.18 | 0.016 | 0.004 | 0.025 | 15.5 | 0.23 | 0.005 | — |
| 2-37 | 0.005 | 0.28 | 0.23 | 0.022 | 0.006 | 0.031 | 12.7 | — | 0.010 | — |
| 2-38 | 0.006 | 0.28 | 0.17 | 0.016 | 0.006 | 0.007 | 12.8 | 2.63 | 0.013 | — |
| 2-39 | 0.002 | 0.32 | 0.20 | 0.017 | 0.005 | 0.009 | 13.5 | 0.15 | 0.013 | — |
| 2-40 | 0.033 | 0.36 | 0.16 | 0.019 | 0.004 | 0.010 | 13.5 | 0.24 | 0.006 | — |
| 2-41 | 0.007 | 0.24 | 0.15 | 0.022 | 0.007 | 0.017 | 13.4 | 0.19 | 0.003 | — |
| 2-42 | 0.012 | 0.31 | 0.16 | 0.016 | 0.004 | 0.015 | 12.8 | 0.23 | 0.065 | — |
| 2-43 | 0.011 | 1.14 | 0.20 | 0.019 | 0.004 | 0.024 | 12.8 | 0.15 | 0.009 | — |
| 2-44 | 0.013 | 0.27 | 0.18 | 0.022 | 0.006 | 0.012 | 16.5 | 0.17 | 0.010 | — |
| 2-45 | 0.006 | 0.46 | 0.06 | 0.021 | 0.005 | 0.024 | 10.8 | 0.82 | 0.007 | — |
| 2-46 | 0.008 | 0.23 | 0.43 | 0.025 | 0.002 | 0.023 | 11.0 | 0.78 | 0.008 | Ti: 0.27 |
| 2-47 | 0.006 | 0.35 | 0.99 | 0.022 | 0.003 | 0.024 | 11.7 | 0.39 | 0.007 | Nb: 0.21 |
| 2-48 | 0.012 | 0.25 | 0.38 | 0.018 | 0.004 | 0.017 | 11.4 | 0.42 | 0.021 | V: 0.06, Zr: 0.08 |
| 2-49 | 0.012 | 0.39 | 0.79 | 0.022 | 0.006 | 0.026 | 12.7 | 0.48 | 0.009 | Mo: 0.23, Ti: 0.22, Y: 0.08, Sb: 0.031 |
| 2-50 | 0.007 | 0.42 | 0.18 | 0.020 | 0.008 | 0.038 | 13.3 | 0.13 | 0.008 | Cu: 0.04, Mo: 0.02, V: 0.03 |
| 2-51 | 0.005 | 0.25 | 0.45 | 0.018 | 0.005 | 0.037 | 11.2 | 0.81 | 0.008 | Cu: 0.02, Mo: 0.03, V: 0.04, Ti: 0.25 |
| 2-52 | 0.011 | 0.28 | 0.49 | 0.024 | 0.004 | 0.022 | 13.3 | 0.93 | 0.012 | Ti: 0.34 |
| 2-53 | 0.007 | 0.24 | 0.13 | 0.023 | 0.006 | 0.046 | 12.4 | 0.27 | 0.006 | V: 0.09 |
| 2-54 | 0.006 | 0.08 | 0.19 | 0.020 | 0.007 | 0.028 | 11.3 | 0.17 | 0.007 | Nb: 0.03, Zr: 0.03 |
| 2-55 | 0.005 | 0.44 | 0.34 | 0.021 | 0.001 | 0.057 | 10.7 | 0.07 | 0.010 | Ti: 0.18, V: 0.05 |
| 2-56 | 0.007 | 0.11 | 0.14 | 0.023 | 0.002 | 0.043 | 11.3 | 0.08 | 0.010 | Ti: 0.16, V: 0.05 |
| 2-57 | 0.009 | 0.38 | 0.56 | 0.015 | 0.005 | 0.005 | 13.3 | 0.88 | 0.011 | Nb: 0.33 |

TABLE 2-2-continued

| Test No. | Formula (1) | Evaluation results of cold-rolled, annealed, and pickled sheet: Corrosion resistance | Formability | Ridging resistance | Remarks |
|---|---|---|---|---|---|
| 2-35 | — | ▲ | ○ | ◇ | Comparative Example |
| 2-36 | — | ○ | □ | ▲ | Comparative Example |
| 2-37 | — | ▲ | ○ | ◇ | Comparative Example |
| 2-38 | — | ○ | ▲ | ◇ | Comparative Example |
| 2-39 | — | ○ | ○ | ▲ | Comparative Example |
| 2-40 | — | ○ | ▲ | ◇ | Comparative Example |
| 2-41 | — | ○ | ○ | ▲ | Comparative Example |
| 2-42 | — | ○ | ▲ | ○ | Comparative Example |
| 2-43 | — | ○ | ▲ | ▲ | Comparative Example |
| 2-44 | — | ○ | □ | ▲ | Comparative Example |
| 2-45 | — | ○ | ○ | ◇ | Example |
| 2-46 | −1.4 | ○ | ○ | ◇ | Example |
| 2-47 | 0.0 | ○ | ○ | ○ | Example |
| 2-48 | −1.3 | ○ | ○ | ◇ | Example |
| 2-49 | −0.2 | ○ | ○ | ○ | Example |
| 2-50 | −0.8 | ○ | ○ | ◇ | Example |
| 2-51 | −1.0 | □ | ○ | ◇ | Example |
| 2-52 | −0.8 | ○ | ○ | ▲ | Comparative Example |
| 2-53 | 0.1 | ○ | ○ | ▲ | Comparative Example |
| 2-54 | 0.1 | ○ | ○ | ▲ | Comparative Example |
| 2-55 | 10.4 | ▲ | ○ | ▲ | Comparative Example |
| 2-56 | 10.1 | ○ | ○ | ▲ | Comparative Example |
| 2-57 | −0.7 | ○ | ○ | ▲ | Comparative Example |

* The balance other than the above-described chemical composition is Fe and incidental impurities.

*[Corrosion resistance] After three corrosion test cycles, samples with a rust area ratio of 20% or less were evaluated as "○" (pass, excellent), samples with a rust area ratio exceeding 20% but not exceeding 30% were evaluated as "□" (pass), and samples with a rust area ratio exceeding 30% were evaluated as "▲" (fail).

*[Formability] A tensile test was performed at room temperature, and samples having a three-direction average of total elongation after fracture (%) of 32% or more were evaluated as "○" (pass, excellent), samples with an average of less than 32% but not less than 28% were evaluated as "□" (pass), and samples with an average of less than 28% were evaluated as "▲" (fail).

*[Ridging resistance] After 23% tensile strain was applied, the case in which the ridging height on the surface of the center of the parallel portion of a test specimen was 2.0 μm or less was evaluated as "◇" (pass, particularly excellent), the case in which the ridging height was more than 2.0 μ m but not more than 2.5 μm was evaluated as "○" (pass, excellent), the case in which the ridging height was more than 2.5 μm but not more than 3.0 μm was evaluated as "□" (pass), and the case in which the ridging height was more than 3.0 μm was evaluated as "▲" (fail).

*[Formula (1)] $54 \times (Ti + V + Zr + Nb) - 5 \times Mn - 19 \times Ni + 1.0$ where the respective element symbols represent the contents (mass %) of the respective elements, and represent 0 when the corresponding elements are not contained.

* Underlines indicate items outside the scope of the disclosed embodiments.

Examples were evaluated as "○" or "□" for corrosion resistance, "○" or "□" for formability, and "◇", "○", or "□" for ridging resistance, indicating excellent corrosion resistance as well as excellent formability and ridging resistance.

A comparative example of Test No. 2-35 had poor corrosion resistance since the Cr content was lower than the component range of the disclosed embodiments.

A comparative example of Test No. 2-36 had poor ridging resistance since the Cr content was higher than the component range of the disclosed embodiments.

A comparative example of Test No. 2-37 had poor corrosion resistance since the Ni content was lower than the component range of the disclosed embodiments.

A comparative example of Test No. 2-38 had poor formability since the Ni content was higher than the component range of the disclosed embodiments.

Comparative examples of Test Nos. 2-39 and 2-41 had poor ridging resistance since the C content and N content, respectively, were lower than the component ranges of the disclosed embodiments.

Comparative examples of Test Nos. 2-40 and 2-42 had poor formability since the C content and the N content, respectively, were higher than the component ranges of the disclosed embodiments.

A comparative example of Test No. 2-43 had poor formability and ridging resistance since the Si content was higher than the component range of the disclosed embodiments.

A comparative example of Test No. 2-44 had poor ridging resistance since the Cr content was higher than the component range of the disclosed embodiments.

A comparative example of Test No. 2-52 had poor ridging resistance since the Ti content was higher than the component range of the disclosed embodiments.

Comparative examples of Test Nos. 2-53, 2-54, and 2-56 had poor ridging resistance since the value of formula (1) exceeded 0.0.

A comparative example of Test No. 2-55 had poor corrosion resistance and ridging resistance since the Cr content was lower than the component range of the disclosed embodiments and the value of formula (1) exceeded 0.0.

A comparative example of Test No. 2-57 had poor ridging resistance since the Nb content was higher than the component range of the disclosed embodiments.

INDUSTRIAL APPLICABILITY

Since a ferritic stainless steel sheet of the disclosed embodiments has excellent corrosion resistance, formability, and ridging resistance, it can be used in home cooking tools, parts of home electric appliances, parts of office and stationery supplies, parts of automobile interiors, pipes for automobile exhaust, building materials, and the like.

The invention claimed is:

1. A ferritic stainless steel sheet having a chemical composition consisting of, by mass %:

C: 0.005 to 0.030%,
Si: 0.05 to 1.00%,
Mn: 0.05 to 1.00%,
P: 0.040% or less,
S: 0.030% or less,
Al: 0.031 to 0.150%,
Cr: 10.8 to 14.4%,
Ni: 1.20 to 2.50%,
N: 0.005 to 0.060%,
optionally at least one element selected from the group consisting of Co, Cu, Mo, W, V, Zr, Nb, B, Mg, Ca, Y, REM, and Sb, and
a balance being Fe and incidental impurities,
wherein:
the steel sheet has an elongation after fracture of 28% or more, and
a surface of the steel sheet has a ridging height of 3.0 μm or less when a tensile strain of 23% is applied in a rolling direction to the steel sheet.

2. The ferritic stainless steel sheet according to claim 1, wherein the chemical composition includes, by mass %, at least one selected from the group consisting of:

Co: 0.01 to 0.50%,
Cu: 0.01 to 0.80%,
Mo: 0.01 to 0.30%, and
W: 0.01 to 0.50%.

3. The ferritic stainless steel sheet according to claim 2, wherein the chemical composition includes, by mass %, at least one selected from the group consisting of:

V: 0.01 to 0.10%,
Zr: 0.01 to 0.10%, and
Nb: 0.01 to 0.30%,
wherein a value of formula (1) below is 0.0 or less:

$$54\times(V+Zr+Nb)-5\times Mn-19\times Ni+1.0 \quad \text{formula (1)}$$

where, in formula (1) above, respective element symbols represent contents (mass %) of respective elements, or 0 when corresponding elements are not present.

4. The ferritic stainless steel sheet according to claim 3, wherein the chemical composition includes, by mass %, at least one selected from the group consisting of:

B: 0.0003 to 0.0030%,
Mg: 0.0005 to 0.0100%,
Ca: 0.0003 to 0.0030%,
Y: 0.01 to 0.20%, and
REM (rare earth metal): 0.001 to 0.100%.

5. The ferritic stainless steel sheet according to claim 4, wherein the chemical composition includes, by mass %, Sb: 0.001 to 0.500%.

6. A method for manufacturing the ferritic stainless steel sheet according to claim 5, the method comprising:

hot-rolling a steel slab having the chemical composition so as to form a hot-rolled sheet;
performing hot-rolled sheet annealing that includes holding the hot-rolled sheet at a temperature in a range of 900° C. or more and 1100° C. or less for 5 seconds to 15 minutes so as to form a hot-rolled and annealed sheet;
cold-rolling the hot-rolled and annealed sheet so as to form a cold-rolled sheet; and
performing cold-rolled sheet annealing that includes holding the cold-rolled sheet at a temperature in a range of 780° C. or more and 830° C. or less for 5 seconds to 5 minutes; thereby producing the ferritic stainless steel sheet of claim 5.

7. The ferritic stainless steel sheet according to claim 3, wherein the chemical composition includes, by mass %, Sb: 0.001 to 0.500%.

8. The ferritic stainless steel sheet according to claim 2, wherein the chemical composition includes, by mass %, at least one selected from the group consisting of:

B: 0.0003 to 0.0030%,
Mg: 0.0005 to 0.0100%,
Ca: 0.0003 to 0.0030%,
Y: 0.01 to 0.20%, and
REM (rare earth metal): 0.001 to 0.100%.

9. The ferritic stainless steel sheet according to claim 8, wherein the chemical composition includes, by mass %, Sb: 0.001 to 0.500%.

10. The ferritic stainless steel sheet according to claim 1, wherein the chemical composition includes, by mass %, at least one selected from the group consisting of:

V: 0.01 to 0.10%,
Zr: 0.01 to 0.10%, and
Nb: 0.01 to 0.30%,
wherein a value of formula (1) below is 0.0 or less:

$$54\times(V+Zr+Nb)-5\times Mn-19\times Ni+1.0 \quad \text{formula (1)}$$

where, in formula (1) above, respective element symbols represent contents (mass %) of respective elements, or 0 when corresponding elements are not present.

11. The ferritic stainless steel sheet according to claim 10, wherein the chemical composition includes, by mass %, at least one selected from the group consisting of:

B: 0.0003 to 0.0030%,
Mg: 0.0005 to 0.0100%,
Ca: 0.0003 to 0.0030%,
Y: 0.01 to 0.20%, and
REM (rare earth metal): 0.001 to 0.100%.

12. The ferritic stainless steel sheet according to claim 11, wherein the chemical composition includes, by mass %, Sb: 0.001 to 0.500%.

13. The ferritic stainless steel sheet according to claim 10, wherein the chemical composition includes, by mass %, Sb: 0.001 to 0.500%.

14. The ferritic stainless steel sheet according to claim 1, wherein the chemical composition includes, by mass %, at least one selected from the group consisting of:

B: 0.0003 to 0.0030%,
Mg: 0.0005 to 0.0100%,
Ca: 0.0003 to 0.0030%,
Y: 0.01 to 0.20%, and
REM (rare earth metal): 0.001 to 0.100%.

15. The ferritic stainless steel sheet according to claim 14, wherein the chemical composition includes, by mass %, Sb: 0.001 to 0.500%.

16. The ferritic stainless steel sheet according to claim 1, wherein the chemical composition includes, by mass %, Sb: 0.001 to 0.500%.

17. A method for manufacturing the ferritic stainless steel sheet according to claim 1, the method comprising:

hot-rolling a steel slab having the chemical composition so as to form a hot-rolled sheet;
performing hot-rolled sheet annealing that includes holding the hot-rolled sheet at a temperature in a range of 900° C. or more and 1100° C. or less for 5 seconds to 15 minutes so as to form a hot-rolled and annealed sheet;

cold-rolling the hot-rolled and annealed sheet so as to form a cold-rolled sheet; and performing cold-rolled sheet annealing that includes holding the cold-rolled sheet at a temperature in a range of 780° C. or more and 830° C. or less for 5 seconds to 5 minutes; thereby producing the ferritic stainless steel sheet of claim 1.

18. The ferritic stainless steel sheet according to claim 2, wherein the chemical composition includes, by mass %, Sb: 0.001 to 0.500%.

* * * * *